US005451337A

United States Patent [19]

Liu et al.

[11] Patent Number: 5,451,337

[45] Date of Patent: * Sep. 19, 1995

[54] DYE TRANSFER INHIBITION SYSTEM CONTAINING A PEROXIDASE/ACCELERATOR SYSTEM

[75] Inventors: Don K. K. Liu, Cincinnati, Ohio; Andre C. Convents, Diegem, Belgium

[73] Assignee: The Procter & Gamble Co., Cincinnati, Ohio

[ * ] Notice: The portion of the term of this patent subsequent to Aug. 29, 2012 has been disclaimed.

[21] Appl. No.: 251,057

[22] Filed: May 31, 1994

[51] Int. Cl.[6] ..... C11D 3/28; C11D 3/386; C11D 3/395; C06L 3/02

[52] U.S. Cl. ..... 252/102; 8/111; 8/137; 252/1; 252/95; 252/99; 252/174.12; 252/524; 252/542; 544/38; 544/102

[58] Field of Search ..... 252/1, 95, 99, 102, 252/174.12, 524, 542; 8/111, 137; 544/38, 102

[56] References Cited

U.S. PATENT DOCUMENTS

| | | | |
|---|---|---|---|
| 3,654,179 | 11/1972 | Bauer | 252/408 |
| 4,077,768 | 3/1978 | Johnston et al. | 8/107 |
| 5,076,950 | 12/1991 | Ulman | 252/62.51 |
| 5,180,514 | 1/1993 | Farr | 252/99 |
| 5,273,896 | 12/1993 | Pedersen | 435/192 |
| 5,286,401 | 2/1994 | Dung et al. | 252/102 |
| 5,356,437 | 10/1994 | Pedersen et al. | 252/174.12 |
| 5,360,568 | 11/1994 | Madison et al. | 252/102 |
| 5,384,248 | 1/1995 | Sakata | 435/25 |
| 5,391,272 | 2/1995 | O'Daly | 204/153.12 |

FOREIGN PATENT DOCUMENTS

| | | | |
|---|---|---|---|
| 0537381A1 | 10/1991 | European Pat. Off. | C11D 3/00 |
| 0538228A1 | 1/1992 | European Pat. Off. | C11D 3/00 |
| 2101167 | 7/1982 | United Kingdom | D06L 3/02 |
| WO89/09813 | 10/1989 | WIPO | C11D 3/395 |

*Primary Examiner*—Dennis Albrecht

*Attorney, Agent, or Firm*—Michael D. Jones; Jerry J. Yetter; Jacobus C. Rasser

[57] ABSTRACT

Dye transfer inhibiting systems are disclosed, comprising an enzyme exhibiting peroxidase activity, a hydrogen peroxide source, an additional oxidizable substrate, and a accelerator preferably having the formula

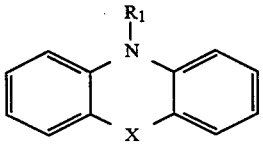

wherein X is S or O and $R_1$ is $—CH_3$, $—CH_2CH_3$, $—CH_2CH_2CH_2NH_2$, or $—CH_2CH_2COOH$ Detergent compositions containing the dye transfer inhibition system and typical detergent ingredients are also disclosed. More effective and efficient dye transer inhibition of fugitive dyes is achieved by using the dye transfer inhibition system as an detergent additive or in a detergent composition matrix.

2 Claims, No Drawings

DYE TRANSFER INHIBITION SYSTEM CONTAINING A PEROXIDASE/ACCELERATOR SYSTEM

FIELD OF THE INVENTION

The present invention relates to a dye transfer inhibition system and detergent compositions containing said dye transfer inhibition system which inhibit the transfer of dye from a dyed fabric to another fabric during washing. The dye transfer inhibition system comprises a peroxidase enzyme, a hydrogen peroxide source, and an accelerator, preferably a phenothiazine or phenoxazine accelerator.

BACKGROUND OF THE INVENTION

One of the most persistent and troublesome problems arising during modern fabric laundering operations is the tendency of some colored fabrics to release dye ("fugitive dye") into the laundering solutions. The dye is then transferred onto other fabrics being washed therewith.

One way of overcoming this problem would be to bleach the fugitive dyes washed out of dyed fabrics before they have the opportunity to become attached to other articles in the wash.

Suspended or solubilized dyes can to some degree be oxidized in solution by employing known bleaching agents.

GB 2 101 167 describes a stable liquid bleaching composition containing a hydrogen peroxide precursor which is activated to yield hydrogen peroxide on dilution.

However, it is important at the same time not to bleach the dyes actually remaining on the fabrics, that is, not to cause color damage.

U.S. Pat. No. 4,077,768 describes a process for inhibiting dye transfer by the use of an oxidizing bleaching agent together with catalytic compounds such as iron porphins.

U.S. patent application 421,414 describes peroxidases and oxidases utilized for the oxidation of organic or inorganic substances, including colored substances.

A dye transfer inhibiting composition comprising an enzymatic system capable of generating hydrogen peroxide and iron catalysts has been disclosed in copending EP Patent Application 91202655.6, filed Oct. 9, 1991.

EP 424 398-A describes a detergent additive capable of exerting a bleaching effect comprising a peroxidase. The additive further comprises one or more enzymes, particularly a lipase, protease, amylase or a cellulase.

Peroxidase enzymes are bleaching enzymes which have been proposed for dye transfer inhibition. It has been determined that to achieve good dye bleaching, particularly at high pH levels, e.g., levels above about 8 or 9, an accelerator is required for the peroxidase enzyme. It has now been surprisingly found that the efficiency of peroxidases in terms of dye transfer inhibition, particularly at pH above about 9, is considerably enhanced by using an accelerator, preferably a phenothiazine or phenoxazine accelerator together with the peroxidase. It is therefore an object of the present invention to provide dye transfer inhibition systems or detergent compositions containing such dye transfer inhibition system which exhibit optimum dye transfer inhibition in wash solutions by using said peroxidase in conjunction with a phenothiazine accelerator.

According to another embodiment of this invention a process is also provided for laundering operations involving colored fabrics.

SUMMARY OF THE INVENTION

The present invention provides a dye transfer inhibition system comprising an effective amount of: an enzyme exhibiting peroxides activity; a hydrogen peroxide source selected from the group consisting of hydrogen peroxide, a hydrogen peroxide precursor and an enzymatic system capable of generating hydrogen peroxide; and an accelerator. The accelerator comprises an organic chemical compound consisting of at least two aromatic rings of which aromatic rings at least one is substituted with one or more of the following atoms: nitrogen, oxygen and sulfur; and which aromatic rings may furthermore be fused rings. Preferably, the accelerator is a compound having the formula:

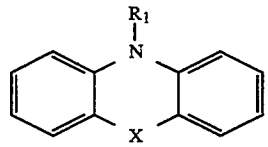

wherein X is S or O, and $R_1$ is $—CH_3$, $—CH_2CH_3$, $—CH_2CH_2CH_2NH_2$, or $—CH_2CH_2COOH$.

In another aspect, the present invention encompasses detergent compositions comprising the dye transfer inhibition system set forth above together with typical detergent ingredients including a detergent surfactant, detergent builder and other detergent adjuncts.

DETAILED DESCRIPTION OF THE INVENTION

The dye transfer inhibition systems herein contain an enzyme exhibiting peroxidase activity, a hydrogen peroxide source, and an accelerator as essential ingredients.

PEROXIDASES

The peroxidases which may be employed in the dye transfer inhibition systems and detergent compositions of the present invention may be isolated from and are producible by plants (e.g. horseradish peroxidase) or microorganisms such as fungi or bacteria. Some preferred fungi include strains belonging to the subdivision Deuteromycotina, class Hyphomycetes, e.g. Fusarium, Humicola, Tricoderma, Myrothecium, Verticillum; is Arthromyces, Caldariomyces, Ulocladium, Embellisia, Cladosporium or Dreschlera, in particular *Fusarium oxysporum* (DSM 2672), *Humicola insolens, Trichoderma resii, Myrotheciurn verrucana* (IFO 6113), *Verticilluum alboatrum, Verticillum dahlie, Arthromyces ramosus* (FERM P-7754), *Caldariomyces fumago, Ulocladiurn chartarum, Embellisia allior Dreschlera halodes.*

Other preferred fungi inlclude strains belonging to the subdivision Basidiomycotina, class Basidiomycetes, e.g. Coprinus, Phanerochaete, Coriolus or Trametes, in particular *Coprinus cinereus* f. microsporus (IFO 8371), *Coprinus macrorhizus, Phanerochaete chrysosporium* (e.g. NA-12) or *Coriolus versicolor* (e.g. PR4 28-A).

Further preferred fungi include strains belonging to the subdivision Zygomycotina, class Mycoraceae, e.g. Rhizopus or Mucor, in particular *Mucor hiemalis.*

Some preferred bacteria include strains of the order Actinomycetales, e.g. *Streptomyces spheroides* (ATTC 23965), *Streptomyces thermoviolaceus* (IFO 12382) or *Streptoverticillum verticillium* ssp. verticillium.

Other preferred bacteria inlude *Bacillus pumillus* (ATCC 12905), *Bacillus stearothermophilus, Rhododbacter sphaeroides, Rhodomonas palustri, Streptococcus lactis, Pseudomonas purrocinia* (ATCC 15958), *Pseudomonas fluorescens* (NRRL B-11) or *Myxococcus virescens.*

Other potential sources of useful peroxidases are listed in B. C. Saunders et al., op. cit., pp. 41–43.

Methods of producing enzymes to be used according to the invention are described in the art, cf. for example FEBS Letters 1625, 173(1), *Applied and Environmental Microbiology,* Feb. 1985, pp. 273–278, *Applied Microbiol. Biotechnol.* 26, 1987, pp. 158–163, *Biotechnology Letters* 9(5), 1987, pp. 357–360, *Nature* 326, 2 April 1987, *FEBS Letters* 4270, 209(2), p. 321, EP 179 486, EP 200 565, GB 2 167 421, EP 171 074, and *Agric. Biol. Chem.* 50(1), 1986, p. 247.

In general, enzymes exhibiting peroxidase activity which are useful in the dye transfer inhibition system of the present invention are set forth in U.S. Pat. No. 5,273,896 (Pedersen et al), issued Dec. 28, 1993, incorporated herein by reference.

Particularly preferred peroxidases are those which are active at the typical pH of washing liquors, i.e. at a pH of 6.5–10.5, preferably 7.0–10.5, and most preferably 7.5–10.5. Such enzymes may be isolated by screening for the relevant enzyme production by alkalophilic microorganisms, e.g. using the ABTS assay described in R. E. Childs and W. G. Bardsley, *Biochem. J.* 145, 1975, pp. 93–103.

Other preferred peroxidases are those which exhibit a good thermostability as well as a good stability towards commonly used detergent components such as nonionic, cationic, or anionic surfactants, detergent builders, phosphate etc.

Another group of useful peroxidases are haloperoxidases, such as chloro- and bromoperoxidases.

The peroxidase-enzyme may furthermore be one which is producible by a method comprising cultivating a host cell transformed with a recombinant DNA vector which carries a DNA sequence encoding said enzyme as well as DNA sequences encoding functions permitting the expression of the DNA sequence encoding the enzyme, in a culture medium under conditions permitting the expression of the enzyme and recovering the enzyme from the culture.

A DNA fragment encoding the enzyme may, for instance, be isolated by establishing a cDNA or genomic library of a microorganism producing the enzyme of interest, such as one of the organisms mentioned above, and screening for positive clones by conventional procedures such as by hybridization to oligonucleotide probes synthesized on the basis of the full or partial amino acid sequence of the enzyme, or by selecting for clones expressing the appropriate enzyme activity, or by selecting for clones producing a protein which is reactive with an antibody against the native enzyme.

Once selected, the DNA sequence may be inserted into a suitable replicable expression vector comprising appropriate promotor, operator and terminator sequences permitting the enzyme to be expressed in a particular host organism, as well as an origin of replication, enabling the vector to replicate in the host organism in question.

The resulting expression vector may then be transformed into a suitable host cell, such as a fungal cell, preferred examples of which are a species of Aspergillus, most preferably *Aspergillus oryzae* or *Aspergillus niger.* Fungal cells may be transformed by a process involving protoplast formation and transformation of the protoplasts followed by regeneration of the cell wall in a manner known per se. The use of Aspergillus as a host microorganism is described in EP 238,023 (of Novo Industri A/S), the contents of which are hereby incorporated by reference. s Alternatively, the host organisms may be a bacterium, in particular strains of Streptomyces and Bacillus, or *E. coli.* The transformation of bacterial cells may be performed according to conventional methods, e.g. as described in T. Maniatis et al., *Molecular Cloning: A Laboratory Manual,* Cold Spring Harbor, 1982.

The screening of appropriate DNA sequences and construction of vectors may also be carried out by standard procedures, cf. T. Maniatis et al., op. cit.

The medium used to cultivate the transformed host cells may be any conventional medium suitable for growing the host cells in question. The expressed enzyme may conveniently be secreted into the culture medium and may be recovered therefrom by well-known procedures including separating the cells from the medium by centrifugation of filtration, precipitating proteinaceous components of the medium by means of a salt such as ammonium sulphate, followed by chromatographic procedures such as ion exchange chromatography, affinity chromatography, or the like.

The screening of appropriate DNA sequences and construction of vectors may also be carried out by standard procedures, cf. T. Maniatis et al., op. cit.

The medium used to cultivate the transformed host cells may be any conventional medium suitable for growing the host cells in question. The expressed enzyme may conveniently be secreted into the culture medium and may be recovered therefrom by well-known procedures including separating the cells from the medium by centrifugation or filtration, precipitating proteinaceous components of the medium by means of a salt such as ammonium sulphate, followed by chromatographic procedures such as ion exchange chromatography, affinity chromatography, or the like.

At the beginning or during the process, $H_2O_2$ may be added, e.g. in an amount of 0.001–5 mM, particularly 0.01–1 mM. When using *Coprinus peroxidase,* 0.01–0.25 mM $H_2O_2$ is preferred, and with *B. pumilus* peroxidase 0.1–1 mM $H_2O_2$.

The hydrogen peroxide may be added as hydrogen peroxide or a precursor thereof, preferably a perborate or percarbonate. The level of hydrogen peroxide precursor that can be used is dependent on the specific properties of the peroxidase chosen, e.g. *Coprinus peroxidase* should be applied in a detergent composition which contains less than 5% perborate.

In the process of this invention, it may be desirable to utilize an enzymatic process for hydrogen peroxide formation. Thus, the process according to the invention may additionally comprise adding an enzymatic system (i.e. an enzyme and a substrate therefor) which is capable of generating hydrogen peroxide at the beginning or during the washing and/or rinsing process.

One such category of hydrogen peroxide generating systems comprises enzymes which are able to convert molecular oxygen and an organic or inorganic substrate into hydrogen peroxide and the oxidized substrate respectively. These enzymes produce only low levels of hydrogen peroxide, but they may be employed to great advantage in the process of the invention as the presence of peroxidase ensures an efficient utilization of the hydrogen peroxide produced.

Preferred hydrogen peroxide-generating enzymes are those which act on cheap and readily available substrates which may conveniently be included into detergent compositions. An example of such a substrate is glucose which may be utilized for hydrogen peroxide production by means of glucose oxidase. Suitable oxidases include those which act on aromatic compounds such as phenols and related substances, e.g. catechol oxidases, laccase. Other suitable oxidases are urate oxidase, galactose oxidase, alcohol oxidases, amine oxidases, amino acid oxidase, amyloglucosidase, and cholesterol oxidase.

The preferred enzymatic systems are alcohol and aidehyde L-amino acid oxidases.

The more preferred systems for granular detergent application would have solid alcohols, e.g. glucose whose oxidation is catalysed by glucose oxidase to glucoronic acid with the formation of hydrogen peroxide.

The more preferred systems for liquid detergent application would involve liquid alcohols which could also act as, for example, solvents. An example is ethanol/ethanol oxidase.

The quantity of oxidase to be employed in compositions according to the invention should be at least sufficient to provide a constant generation of 0.01 to 10 ppm AvO per minute in the wash. For example, with the glucose oxidase, this can be achieved at room temperature and at pH 6 to 11, preferentially 7 to 9 with 50–5000 U/l glucose oxidase, 0.005 to 0.5 % glucose under constant aeration.

The addition of another oxidisable substrate for the peroxidase at the beginning or during the washing and/or rinsing process may enhance the dye transfer inhibitory effect of the peroxidase employed. This is thought to be ascribable to the formation of short-lived radicals or other oxidized states of this substrate which participate in the bleaching or other modification of the colored substance. Examples of such oxidisable substrates are metal ions, e.g. $Mn^{++}$, halide ions, e.g. chloride or bromide ions, or organic compounds such as phenols, e.g. p-hydroxycirmamic acid or 2,4-dichlorophenol. Other examples of phenolic compounds which may be used for the present purpose are those given in M. Kato and S. Shimizu, *Plant Cell Physiol.* 26(7), 1985, pp. 1291–1301 (cf. Table 1 in particular) or B. C. Saunders et al., op. cit., p. 141 ff. The amount of oxidisable substrate to be added is suitably between about 1 μM and 1 mM.

In the process of the invention, the peroxidase will typically be added as a component of a detergent composition and may be added in an amount of 0.01–100 mg enzyme per liter of wash liquid. As such, it may be included in the detergent composition in the form of a non-dusting granulate, a liquid, in particular a stabilized liquid, or a protected enzyme. Non-dusting granulates may be produced, e.g. as disclosed in U.S. Pat. Nos. 4,106,991 and 4,661,452 (both to Novo Industfi A/S) and may optionally be coated by methods known in the art. Liquid enzyme preparations may, for instance, be stabilized by adding a polyol such as propylene glycol, a sugar or sugar alcohol, lactic acid or boric acid according to established methods. Other enzyme stabilizers are well known in the art. Protected enzymes may be prepared according to the method disclosed in EP 238,216. The detergent composition may also comprise one or more substrates for the peroxidase. Usually, the pH of a solution of the detergent composition of the invention will be preferably from 7–12, especially from 7.5 to 9.5. The wash pH is dependent on the peroxidase chosen, e.g. *Coprinus peroxidase* should be applied in a wash pH below 9.5.

ACCELERATORS

The present invention relates to the use of chemical compounds for enhancing the activity of peroxidase enzymes or peroxidase acting compounds. Accordingly, the invention provides an agent capable of enhancing the effect of a peroxidase enzyme or a peroxidase acting compound, in the following accelerator (hereinafter also referred to as an enhancing agent.

Contrary to the accelerators known and previously described, the accelerators of this invention are capable of acting at alkaline conditions, i.e., at pH levels above about 8. This feature allows the accelerators of the invention to be implemented into various processes including laundering of fabrics.

Basically, the accelerator is an organic chemical compound consisting of at least two aromatic tings of which aromatic rings at least one is substituted with one or more of the following atoms: nitrogen, oxygen and sulfur; and which aromatic tings may furthermore be fused rings.

In a more preferred embodiment, the enhancing agent of the invention is an organic chemical compound of the general formula I:

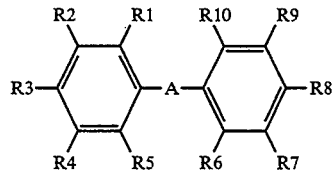

in which general formula A represents a single bond, or one of the following groups: $(—CR^{11}=CR^{15}—)_n$, $(—NR^{11}—)$, $(—CR^{11}=N—)_n$, $(—NR^{11}—CR^{12}=N—N=CR^{13}—NR^{15}—)$, $(—NR^{11}—CR^{12}=N—N=CR^{15}—)$, $(—NR^{11}—CR^{12}=N—)_n$, $(—CR^{12}=N—NR^{11}—)$, $(—NR^{11}—CR^{12}=CR^{13}—)$, $(—N=N—)$, in which groups n represents an integer of from 1 to 6; or A represents carbon, carbonyl, nitrogen, sulfur, oxygen, selenium, or phosphor, which carbon, phosphor and nitrogen may be unsubstituted or substituted with a substituent group $R^{11}$;

and in which general formula the substituent groups $R^1$–$R^{13}$ and $R^{15}$, which may be identical or different, independently represents any of the following radicals: hydrogen, halogen, hydroxy, formyl, carboxy and esters and salts hereof, carbamoyl, sulfo and esters and salts hereof, sulfamoyl, phospho, phosphono, phosphonooxy, sulfandiyl, nitro, amino, phenyl, $C_1$–$C_{14}$-alkyl, $C_1$–$C_5$-alkoxy, carbonyl-$C_1$–$C_5$-alkyl, aryl-$C_1$–$C_5$-alkyl; which carbamoyl, sulfamoyl, and amino groups may furthermore be unsubstituted or substituted once or twice with a substituent group $R^{14}$; and which phenyl may furthermore be unsubstituted or substituted with one or more substituent groups $R^{14}$; and which $C_1$–$C_{14}$-alkyl, $C_1$–$C_5$-alkoxy, carbonyl-$C_1$–$C_5$-alkyl, and aryl-$C_1$–$C_5$-alkyl groups may be saturated or unsaturated, branched or unbranched, and may furthermore be unsubstituted or substituted with one or more substituent groups $R^{14}$;

which substituent group $R^{14}$ represents any of the following radicals: halogen, hydroxy, formyl, carboxy and esters and salts hereof, carbamoyl, sulfo and esters and salts hereof, sulfamoyl, nitro, amino, phenyl, aminoalkyl, piperidino, piperazinyl, pyrrolidino, $C_1$–$C_5$-alkyl, $C_1$–$C_5$-alkoxy; which carbamoyl, sulfamoyl, and amino groups may furthermore be unsubstituted or substituted once or twice with hydroxy, $C_1$–$C_5$-alkyl, $C_1$–$C_5$-alkoxy; and which phenyl may furthermore be substituted with one or more of the following radicals: halogen, hydroxy, amino, formyl, carboxy and esters and salts hereof, carbamoyl, sulfo and esters and salts hereof, and sulfamoyl; and which $C_1$–$C_5$-alkyl, and $C_1$–$C_5$-alkoxy groups may furthermore be saturated or unsaturated, branched or unbranched, and may furthermore be substituted once or twice with any of the following radicals: halogen, hydroxy, amino, formyl, carboxy and esters and salts hereof, carbamoyl, sulfo and esters and salts hereof, and sulfamoyl;

or in which general formula $R^5$ and $R^6$ may together form a group —B—, in which B represents a single bond, the group $(—CH{=}CH—)_n$, or the group $(—CH{=}N—)_n$, in which groups n represents an integer of from 1 to 6; or B represents carbon, nitrogen, sulfur, oxygen, selenium, or tellurium, which carbon and nitrogen may be unsubstituted or substituted with a substituent group $R^{14}$ as defined above;

or in which general formula two of the substituent groups $R^1$–$R^{10}$ may together form a group —C—, in which C represents any of the following groups: $(—CHR^{11}—N{=}N—)$, $(—CH{=}CH—)_n$, $(—CH{=}N—)_n$, in which groups n represents an integer of from 2 to 4, and in which groups $R^{11}$ is a substituent group as defined above;

or in which general formula $R^5$ and $R^{12}$, and/or $R^6$ and $R^{13}$ when n in the above formula being 1, may together form a group —D—, in which D represents the groups: $(—CHR^{11}—)$, $(—NR^{11}—)$, $(—CR^{11}{=}CR^{15}—)$, $(—CR^{11}{=}N—)$, $(—N{=}CR^{11}—)$, (—O—), (>C=O) or (—S—), and in which groups $R^{11}$ and $R^{15}$ are substituent groups as defined above.

In particular embodiments, the enhancing agent is 2,2'-azino-bis(3-ethylbenzothiazoline-6-sulfonate), 6-amino-3-methyl-2-benzothiazolinone azine with 3-methyl-2-benzothiazolinone, 2-(p-aminophenyl)-6-methylbenzothiazole-7-sulfonic acid, N-(4-(dimethylamino)benzylidene)-p-anisidine, 3-methyl-2-benzothiazolinone(4-(dimethylamino)benzylidene)-hydrazone.

In another preferred embodiment, the enhancing agent of the invention is an organic chemical compound of the general formula II:

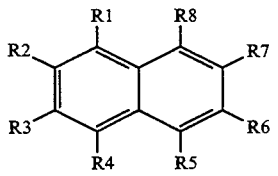

in which the substituent groups $R^1$–$R^8$, which may be identical or different, independently represents any of the following radicals: hydrogen, halogen, hydroxy, formyl, carboxy and esters and salts hereof, carbamoyl, sulfo and esters and salts hereof, sulfamoyl, nitro, amino, phenyl, $C_1$–$C_{14}$-alkyl, $C_1$–$C_5$-alkoxy, carbonyl-$C_1$–$C_5$-alkyl, aryl-$C_1$–$C_5$-alkyl; which carbamoyl, sulfamoyl, and amino groups may furthermore be unsubstituted or substituted once or twice with a substituent group $R^9$; and which phenyl may furthermore be unsubstituted or substituted with one or more substituent groups $R^9$; and which $C_1$–$C_{14}$-alkyl, $C_1$–$C_5$-alkoxy, carbonyl-$C_1$–$C_5$-alkyl, and aryl-$C_1$–$C_5$-alkyl groups may be saturated or unsaturated, branched or unbranched, and may furthermore be unsubstituted or substituted with one or more substituent groups $R^9$;

which substituent group $R^9$ represents any of the following radicals: halogen, hydroxy, formyl, carboxy and esters and salts hereof, carbamoyl, sulfo and esters and salts hereof, sulfamoyl, nitro, amino, phenyl, $C_1$–$C_5$-alkyl, $C_1$–$C_5$-alkoxy; which carbamoyl, sulfamoyl, and amino groups may furthermore be unsubstituted or substituted once or twice with hydroxy, $C_1$–$C_3$-alkyl, $C_1$–$C_3$-alkoxy; and which phenyl may furthermore be substituted with one or more of the following radicals: halogen, hydroxy, amino, formyl, carboxy and esters and salts hereof, carbamoyl, sulfo and esters and salts hereof, and sulfamoyl; and which $C_1$–$C_5$-alkyl, and $C_1$–$C_5$-alkoxy groups may furthermore be saturated or unsaturated, branched or unbranched, and may furthermore be substituted once or twice with any of the following radicals: halogen, hydroxy, amino, formyl, carboxy and esters and salts hereof, carbamoyl, sulfo and esters and salts hereof, and sulfamoyl;

or in which general formula two of the substituent groups $R^1$–$R^8$ may together form a group —B—, in which B represents any of the following groups: $(—N{=}N—)$, $(—CH{=}CH—)_n$, $(—CH{=}N—)_n$, $(—N{=}CR^9—NR^{10}—)$ or $(—N{=}N—CR^9—)$, in which groups n represents an integer of from 1 to 3, $R^9$ is a substituent group as defined above and $R^{10}$ is defined as $R^9$.

In a more specific embodiment, the enhancing agent of the invention is an organic chemical compound of the following formula:

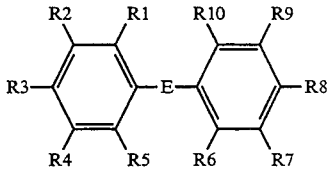

in which formula E represents a single bond, a carbonyl group or one of the following groups: $(—CH{=}CH—)_n$, $(—CH{=}N—)_n$ or $(—NR^{11}—)$, in which n represents an integer from 1 to 2. The substituents groups $R^1$–$R^{11}$ may be identical or different, independently being one of the following radicals: hydrogen, halogen, hydroxy, formyl, carboxy and esters and salts hereof, carbamoyl, sulfo and esters and salts hereof, sulfamoyl, nitro, amino, phenyl, $C_1$–$C_{14}$-alkyl, $C_1$–$C_5$-alkoxy, carbonyl-$C_1$–$C_5$-alkyl, aryl-$C_1$–$C_5$-alkyl; which carbamoyl, sulfamoyl, and amino groups may furthermore be unsubstituted or substituted once or twice with a substituent group $R^{14}$; and which phenyl may furthermore be unsubstituted or substituted with one or more substituent groups $R^{14}$; and which $C_1$–$C_{14}$-alkyl, $C_1$–$C_5$-alkoxy, carbonyl-$C_1$–$C_5$-alkyl, and aryl-$C_1$–$C_5$-alkyl groups may be saturated or unsaturated, branched or unbranched, and may furthermore be unsubstituted or substituted with one or more substituent groups $R^{14}$;

which substituent group $R^{14}$ represents any of the following radicals: halogen, hydroxy, formyl, carboxy and esters and salts hereof, carbamoyl, sulfo and esters and salts hereof, sulfamoyl, nitro, amino, phenyl, $C_1$–$C_5$-alkyl, $C_1$–$C_5$-alkoxy; which carbamoyl, sulfamoyl, and amino groups may furthermore be unsubstituted or substituted once or twice with hydroxy, $C_1$–$C_3$-alkyl, $C_1$–$C_3$-alkoxy; and which phenyl may furthermore be substituted with one or more of the following radicals: halogen, hydroxy, amino, formyl, carboxy and esters and salts hereof, carbamoyl, sulfo and esters and salts hereof, and sulfamoyl; and which $C_1$–$C_5$-alkyl, and $C_1$–$C_5$-alkoxy groups may furthermore be saturated or unsaturated, branched or unbranched, and may furthermore be substituted once or twice with any of the following radicals: halogen, hydroxy, amino, formyl, carboxy and esters and salts hereof, carbamoyl, sulfo and esters and salts hereof, and sulfamoyl;

or in which specific formula two of the substituent groups $R^5$ and $R^6$ may together form a group —B—, in which B represents the groups: $(—CH{=}N—)_n$, (—CH=CH—) or $(—CHR^{14}—)$ in which groups n represents an integer of from 1 to 2 and $R^{14}$ is a substituent group as defined above.

In particular embodiments, the enhancing agent is 4-amino-4'-methoxystilbene, 4,4'-diaminostilbene-2,2'-disulfonic acid, iminostilbene, 4,4'-dihydroxybenzophenone, N-benzylidene-4-biphenylamine, 4,4'-diaminodiphenylamine, 4,4'-diaminodiphenylaminesulfate, 2,7-diaminofluorene, triphenylamine.

In another specific embodiment, the enhancing agent may be described by the following formula:

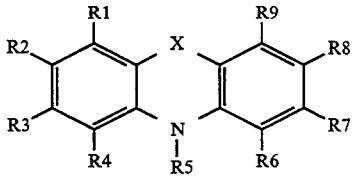

in which formula X represents one of the following groups: (—O—), (—S—), $(—NR^{15}—)$, $(—CHR^{15}—)$, (>C=O), (—CH=CH—), (—CH=N—) and the substituent groups $R^1$–$R^9$ and $R^{15}$, which may be identical or different, independently represents any of the following radicals: hydrogen, halogen, hydroxy, formyl, carboxy and esters and salts hereof, carbamoyl, sulfo and esters and salts hereof, sulfamoyl, nitro, amino, phenyl, $C_1$–$C_{14}$-alkyl, $C_1$–$C_5$-alkoxy, carbonyl-$C_1$–$C_5$-alkyl, aryl-$C_1$–$C_5$-alkyl; which carbamoyl, sulfamoyl, and amino groups may furthermore be unsubstituted or substituted once or twice with a substituent group $R^{10}$; and which phenyl may furthermore be unsubstituted or substituted with one or more substituent groups $R^{10}$; and which $C_1$–$C_{14}$-alkyl, $C_1$–$C_5$-alkoxy, carbonyl-$C_1$–$C_5$-alkyl, and aryl-$C_1$–$C_5$-alkyl groups may be saturated or unsaturated, branched or unbranched, and may furthermore be unsubstituted or substituted with one or more substituent groups $R^{10}$;

which substituent group $R^{10}$ represents any of the following radicals: halogen, hydroxy, formyl, carboxy and esters and salts hereof, carbamoyl, sulfo and esters and salts hereof, sulfamoyl, nitro, amino, phenyl, aminoalkyl, piperidino, piperazinyl, pyrrolidino, $C_1$–$C_5$-alkyl, $C_1$–$C_5$-alkoxy; which carbamoyl, sulfamoyl, and amino groups may furthermore be unsubstituted or substituted once or twice with hydroxy, $C_1$–$C_5$-alkyl, $C_1$–$C_5$-alkoxy; and which phenyl may furthermore be substituted with one or more of the following radicals: halogen, hydroxy, amino, formyl, carboxy and esters and salts hereof, carbamoyl, sulfo and esters and salts hereof, and sulfamoyl; and which $C_1$–$C_5$-alkyl, and $C_1$–$C_5$-alkoxy groups may furthermore be saturated or unsaturated, branched or unbranched, and may furthermore be substituted once or twice with any of the following radicals: halogen, hydroxy, amino, formyl, carboxy and esters and salts hereof, carbamoyl, sulfo and esters and salts hereof, and sulfamoyl;

or in which general formula two of the substituent groups $R^1$–$R^8$ may together form a group —B—, in which B represents any of the following the groups: $(—CHR^{10}—N{=}N—)$, $(—CH{=}CH—)_n$, (—CH=N—), or $(—N{=}CR^{10}—NR^{11}—)$, in which groups n represents an integer of from 1 to 3, $R^{10}$ is a substituent group as defined above and $R^{11}$ is defined as $R^{10}$.

In particular embodiments, the enhancing agent is 10-methylphenothiazine, 10-phenothiazine-propionic acid, N-hydroxysuccinimide-10-phenothiazine-propionate or 10-ethyl-4-phenothiazine-carboxylic acid, 10-ethylphenothiazine, 10-propylphenothiazine, 10-isopropylphenothiazine, methyl-10-phenothiazinepropionate, 10-phenylphenothiazine, 10-allylphenothiazine, 10-(3-(4-methyl-1-piperazinyl)propyl)phenothiazine, 10-(2-pyrrolidinoethyl)phenothiazine, chlorpromazine, 2-chloro-10-methylphenothiazine, 2-acetyl-10-methylphenothiazine, 4-carboxy-10-phenothiazine, 10-methylphenoxazine, 10-ethylphenoxazine, 10-phenoxazine-propionic acid or 4-carboxy-10-phenoxazine-propionic acid.

In another specific embodiment, enhancing agent is a biphenyl derivative of the following formula:

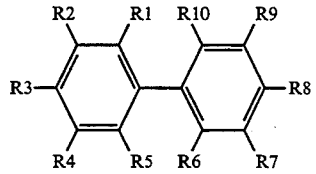

in which the substituent groups $R^1$–$R^{10}$, which may be identical or different, independently represents any of the following radicals: hydrogen, halogen, hydroxy, formyl, carboxy and esters and salts hereof, carbamoyl, sulfo and esters and salts hereof, sulfamoyl, nitro, amino, phenyl, $C_1$–$C_{14}$-alkyl, $C_1$–$C_5$-alkoxy, carbonyl-$C_1$–$C_5$-alkyl, aryl-$C_1$–$C_5$-alkyl; which carbamoyl, sulfamoyl, and amino groups may furthermore be unsubstituted or substituted once or twice with a substituent group $R^{11}$; and which phenyl may furthermore be unsubstituted or substituted with one or more substituent groups $R^{11}$; and which $C_1$–$C_{14}$-alkyl, $C_1$–$C_5$-alkoxy, carbonyl-$C_1$–$C_5$-alkyl, and aryl-$C_1$–$C_5$-alkyl groups may be saturated or unsaturated, branched or unbranched, and may furthermore be unsubstituted or substituted with one or more substituent groups $R^{11}$;

which substituent group $R^{11}$ represents any of the following radicals: halogen, hydroxy, formyl, carboxy and esters and salts hereof, carbamoyl, sulfo and esters and salts hereof, sulfamoyl, nitro, amino, phenyl, $C_1$–$C_5$-alkyl, $C_1$–$C_5$-alkoxy; which carbamoyl, sulfamoyl, and amino groups may furthermore be unsubstituted or substituted once or twice with hydroxy, $C_1$–$C_3$-alkyl, $C_1$–$C_3$-alkoxy; and which phenyl may furthermore be substituted with one or more of the following radicals: halogen, hydroxy, amino, formyl, carboxy and esters and salts hereof, carbamoyl, sulfo and esters and salts hereof, and sulfamoyl; and which $C_1$–$C_5$-alkyl, and $C_1$–$C_5$-alkoxy groups may furthermore be saturated or unsaturated, branched or unbranched, and may furthermore be substituted once or twice with any of the following radicals: halogen, hydroxy, amino, formyl, carboxy and esters and salts hereof, carbamoyl, sulfo and esters and salts hereof, and sulfamoyl.

In particular embodiments, the enhancing agent is benzidine, 3,3'-dimethylbenzidine, 3,3'-dimethoxybenzidine, 3,3',5,5'-tetramethylbenzidine, 4'-hydroxy-4-biphenylcarboxylic acid, or 4,4'-dihydroxybiphenylene.

In another specific embodiment, the enhancing agent is a naphthalene derivative of the following formula:

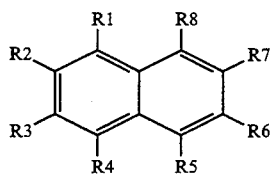

in which the substituent groups $R^1$–$R^8$, which may be identical or different, independently represents any of the following radicals: hydrogen, halogen, hydroxy, formyl, carboxy and esters and salts hereof, carbamoyl, sulfo and esters and salts hereof, sulfamoyl, nitro, amino, phenyl, $C_1$–$C_{14}$-alkyl, $C_1$–$C_5$-alkoxy, carbonyl-$C_1$–$C_5$-alkyl, aryl-$C_1$–$C_5$-alkyl; which carbamoyl, sulfamoyl, and amino groups may furthermore be unsubstituted or substituted once or twice with a substituent group $R^9$; and which phenyl may furthermore be unsubstituted or substituted with one or more substituent groups $R^9$; and which $C_1$–$C_{14}$-alkyl, $C_1$–$C_5$-alkoxy, carbonyl-$C_1$–$C_5$-alkyl, and aryl-$C_1$–$C_5$-alkyl groups may be saturated or unsaturated, branched or unbranched, and may furthermore be unsubstituted or substituted with one or more substituent groups $R^9$;

which substituent group $R^9$ represents any of the following radicals: halogen, hydroxy, formyl, carboxy and esters and salts hereof, carbamoyl, sulfo and esters and salts hereof, sulfamoyl, nitro, amino, phenyl, $C_1$–$C_5$-alkyl, $C_1$–$C_5$-alkoxy; which carbamoyl, sulfamoyl, and amino groups may furthermore be unsubstituted or substituted once or twice with hydroxy, $C_1$–$C_3$-alkyl, $C_1$–$C_3$-alkoxy; and which phenyl may furthermore be substituted with one or more of the following radicals: halogen, hydroxy, amino, formyl, carboxy and esters and salts hereof, carbamoyl, sulfo and esters and salts hereof, and sulfamoyl; and which $C_1$–$C_5$-alkyl, and $C_1$–$C_5$-alkoxy groups may furthermore be saturated or unsaturated, branched or unbranched, and may furthermore be substituted once or twice with any of the following radicals: halogen, hydroxy, amino, formyl, carboxy and esters and salts hereof, carbamoyl, sulfo and esters and salts hereof, and sulfamoyl;

or in which general formula two of the substituent groups $R^1$–$R^8$ may together form a group —B—, in which B represents any of the following groups: (—N=N—), $(—CH=CH—)_n$, $(—CH=—)_n$, (—N=C-$R^9$—$NR^{10}$—) or (—N=N—$CR^9$—), in which groups n represents an integer of from 1 to 3, $R^9$ is a substituent group as defined above and $R^{10}$ is defined as $R^9$.

In particular embodiments, the enhancing agent is 6-hydroxy- 2 -naphtoic acid, 6-bromo-2-naphtol, 7 -methoxy-2-naphtol, 7-amino-2-naphthalene sulfonic acid, 5 -amino-2-naphthalene sulfonic acid, 1,5-diaminonaphthalene, 7-hydroxy-1,2-naphthimidazole, 5-amino-2-naphthalenesulfonic acid, 1,6-dibromo-2-naphtol or 7-methoxy-2-naphtol.

The preferred dye transfer inhibition systems and detergent compositions of the invention herein contain a phenothiazine or phenoxazine accelerator of the formula:

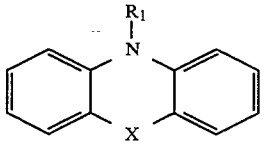

wherein X is S or O, $R_1$ is —$CH_3$, —$CH_2CH_3$, —$CH_2CH_2CH_2NH_2$, or —$CH_2CH_2COOH$. Preferred of the above accelerators is 10-phenothiazineproprionic acid, i.e., wherein $R_1$ is —$CH_2CH_2COOH$. The accelerator is present at a level of from about 0.01% to about 5%, preferably from about 0.1% to about 0.5%, by weight.

The phenothiazine accelerators are synthesized from 10-H-phenothiazine and are commercially available from Aldrich Chemical.

As compared to other dye transfer inhibition systems, the peroxidase-phenothiazine accelerator dye transfer inhibition system provide greater efficiencies with respect to bleaching fugitive dyes in wash water solutions. The dye transfer inhibition systems of the invention hereof provide good dye transfer inhibition performance with, e.g., about 50 to 75% less peroxidase when compared to the dye transfer inhibition performance of similar systems which lack the phenothiazine accelerator.

Other preferred accelerators not in the phenothiazine or phenoxazine classes are accelerators of the formula:

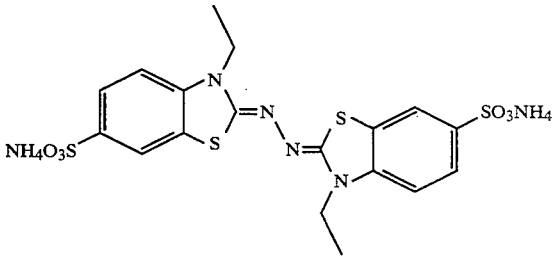

ABTS[2,2'-Azinobis(3-ethyl benzo thiazoline-6-sulfonic acid ammonium salt)]

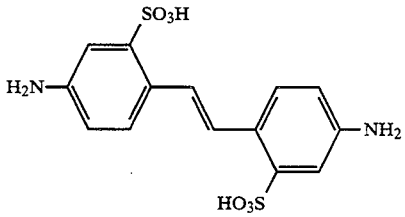

4,4'-Diaminostilbene-2,2'-disulfonic acid

Naturally occurring peroxidase enzymes typically show low activity against most common substrates at pH above about 9. Thus, peroxidase-based dye transfer inhibition (DTI) systems are ineffective in most detergent matrices where pH levels can range from about 9.5 to 10.5 and as high as about 11. The phenothiazine accelerators of the invention herein have been identified as efficient peroxidase accelerators even at pH levels above about 10. This allows for the formulation of DTI systems which are effective at high pH levels and which contain naturally occurring peroxidases and nature-identical peroxidases produced by genetic engineering.

Although not wishing to be bound by theory, it is believed that the accelerator appears to be reversibly oxidized and reduced back to the original compound allowing for low levels of the accelerator to be used. The reversibility appears to be the result of a relatively stable radical cation countered on the nitrogen atom. For 10-phenothiazine is proprionic acid, the radical cation could be stabilized by the formation of an intramolecualar ion pair with the ionized propionic acid moeity.

The levels and ratios of the active components of the DTI system, i.e., hydrogen peroxide, peroxidase enzyme, and phenothiazine accelerator, can have an effect on the performance of the system. For optimal performance, the DTI system contains from about 50 μM to about 500 μM hydrogen peroxide; from about 0.05 PODU/mL to about 5 PODU/mL peroxidase; and from about 5 μM to about 50 μM phenothiazine accelerator. The weight ratio of peroxidase to accelerator is preferably from about 1:20 to about 1:200.

In detergent compositions containing the DTI systems wherein a fixed level of hydrogen peroxide in the wash solution is about 100μM, the level of peroxidase is from about 0.05 to about 2 PODU, preferably about 0.1 to about 1 PODU, and the level of phenothiazine accelerator is from about 0.01 to about 1%, preferably from about 0.05 to about 0.2%, by weight.

DETERGENT ADJUNCTS

The present invention herein also pertains to detergent compositions which contain the dye transfer inhibition system herein and typical detergent components in the usual amounts. Thus, organic surfactants anionic, nonionic, ampholytic, or zwitterionic or less usually cationic and mixtures thereof, may be present. Suitable surfactants are well known in the art and an extensive list of such compounds is given in U.S. Pat. No. 3,717,630 and in U.S. patent application Ser. No. 589,116.

Detergent compositions useful in the present invention contain from 1 to 95%, preferable from 5 to 40% of a nonionic, anionic, zwitterionic, or mixtures thereof. Detergency builders, whether inorganic or organic, phosphatic or not, water-soluble or insoluble, and other water-soluble salts may be present, and salts of this sort may be employed whether organic detergents are present or not. A description of suitable builders is given in U.S. Pat. No. 3,936,537 and in U.S. patent application Ser. No. 589,116. Detergent builders are present from 0 to 50%, preferably from 5 to 40%.

Other components used in detergent compositions may be employed, such as suds is boosting or depressing agents, enzymes and stabilizers or activators, soil-suspending agents soil-release agents, optical brighteners, abrasives, bactericides, tarnish inhibitors, coloring agents, and perfumes.

These components, particularly the enzymes, optical brighteners, coloring agents, and perfumes, should preferably be chosen such that they are compatible with the bleach component of the composition.

The detergent compositions according to the invention can be in liquid, paste or granular forms. The enzyme may be formulated in any convenient form, e.g. as a powder or liquid. The enzyme may be stabilized in a liquid by inclusion of enzyme stabilizers. Liquid detergents may further include stabilized hydrogen peroxide precursors.

Granular compositions according to the present invention can also be in "compact form", i.e. they may have a relatively higher density than conventional granular detergents, i.e. from 550 to 950 g/l; in such case, the granular detergent compositions according to the present invention will contain a lower amount of "inorganic filler salt", compared to conventional granular detergents; typical filler salts are alkaline earth metal salts of sulphates and chlorides, typically sodium sulphate; "compact" detergents typically comprise not more than 10% filler salt.

The present invention also relates to a process for inhibiting dye transfer from one fabric to another of solubilized and suspended dyes encountered during fabric laundering operations involving colored fabrics.

The process comprises contacting fabrics with a laundering solution as hereinbefore described.

The process of the invention is conveniently carried out in the course of the washing process. The washing process is preferably carried out at 5° C. to 75° C., especially 20° C. to 60° C. The pH of the treatment solution is preferably from 7 to 12, especially from 7 to 9.5.

OPTIONAL INGREDIENTS

The present compositions will typically include optional ingredients that normally form part of detergent compositions. Antiredeposition and soil suspension agents, optical brighteners, bleaches, bleach activators, suds suppressors, antitacking agents, dyes and pigments are examples of such optional ingredients and can be added in varying amounts as desired.

Antiredeposition and soil suspension agents suitable herein include cellulose derivatives such as methylcellulose, carboxymethylcellulose and hydroxyethylcellulose, and homo- or co-polymeric polycarboxylic acids or their salts. Polymers of this type include the polyacrylates and maleic arthydride-acrylic acid copolymers previously mentioned as builders, as well as copolymers of maleic arthydride with ethylene, methylvinyl ether or methacrylic acid, the maleic anhydride constituting at least 20 mole percent of the copolymer. These materials are normally used at levels of from 0.5% to 10% by weight, more preferably from 0.75% to 8%, most preferably from 1% to 6% by weight of the composition.

Preferred optical brighteners are anionic in character, examples of which are disodium 4,4$^1$-bis-(2-diethanolamino-4-anilino-s-triazin-6-ylamino)stilbene-2:2$^1$disulphonate, disodium 4,-4$^1$-bis-(2-morpholino-4-anilino-s-triazin-6-ylaminostilbene-2:2$^1$-disulphonate, disodium 4,4$^1$-bis-(2,4-dianilino-s-triazin-6-ylamino)stilbene-2:2$^1$-disulphonate, monosodium 4$^1$,4$^{11}$-bis-(2,4-dianilino-s-triazin-6ylamino)stilbene-2-sulphonate, disodium 4,4$^1$-bis-(2-anilino-4-(N-methyl-N-2-hydroxyethylamino)-s-triazin-6-ylamino)stilbene-2,2$^1$-disulphonate, disodium 4,4$^1$-bis-(4-phenyl-2,1,3-triazol-2-yl)-stilbene-2,2$^1$disulphonate, disodium 4,4$^1$ bis(2-anilino-4-(1-methyl-2-hydroxyethylamino)-s-triazin-6-ylamino)stilbene-2,2$^1$ disulphonate and sodium 2(stilbyl-4$^{11}$-(naphtho-1$^1$,2$^1$:4,5)-1,2,3 - triazole-2$^{11}$-sulphonate.

Any particulate inorganic perhydrate bleach can be used, in an mount of from 3% to 40% by weight, more preferably from 8% to 25% by weight and most preferably from 12% to 20% by weight of the compositions.

Preferred examples of such bleaches are sodium perborate monohydrate and tetrahydrate, percarbonate, and mixtures thereof.

Another preferred separately mixed ingredient is a peroxy carboxylic acid bleach percursor, commonly referred to as a bleach activator, which is preferably added in a prilled or agglomerated form. Examples of suitable compounds of this type are disclosed in British Patent Nos. 1586769 and 214323 1 and a method for their formation into a prilled form is described in European Published Patent Application No. 0 062 523. Preferred examples of such compounds are tetracetyl ethylene diamine and sodium 3,5,5 trimethyl hexanoyloxybenzene sulphonate.

Bleach activators are normally employed at levels of from 0.5% to 10% by weight, more frequently from 1% to 8% and preferably from 2% to 6% by weight of the composition.

Another optional ingredient is a suds suppressor, exemplified by silicones, and silicasilicone mixtures. Silicones can be generally represented by alkylated polysiloxane materials while silica is normally used in finely divided forms exemplified by silica aerogels and xerogels and hydrophobic silicas of various types. These materials can be incorporated as particulates in which the suds suppressor is advantageously releasably incorporated in a water-soluble or water-dispersible, substantially non-surface-active detergent impermeable carrier. Alternatively the suds suppressor can be dissolved or dispersed in a liquid carrier and applied by spraying on to one or more of the other components.

As mentioned above, useful silicone suds controlling agents can comprise a mixture of an alkylated siloxane, of the type referred to hereinbefore, and solid silica. Such mixtures are prepared by affixing the silicone to the surface of the solid silica. A preferred silicone suds controlling agent is represented by a hydrophobic silanated (most preferably trimethylsilanated) silica having a particle size in the range from 10 millimicrons to 20 millimicrons and a specific surface area above 50 $m^2/g$ intimately admixed with dimethyl silicone fluid having a molecular weight in the range from about 500 to about 200,000 at a weight ratio of silicone to silanated silica of from about 1:1 to about 1:2.

A preferred silicone suds controlling agent is disclosed in Bartollota et al. U.S. Pat. No. 3,933,672. Other particularly useful suds suppressors are the self-emulsifying silicone suds suppressors, described in German Patent Application DTOS 2,646,126 published Apr. 28, 1977. An example of such a compound is DC-544, commercially availably from Dow Coming, which is a siloxane/glycol copolymer.

The suds suppressors described above are normally employed at levels of from 0.001% to 2% by weight of the composition, preferably from 0.01% to 1% by weight. The incorporation of the suds mofidiers is preferably made as separate particulates, and this permits the inclusion therein of other suds controlling materials such as C20–C24 fatty acids, microcrystalline waxes and high MW copolymers of ethylene oxide and propylene oxide which would otherwise adversely affect the dispersibility of the matrix. Techniques for forming such suds modifying particulates are disclosed in the previously mentioned Bartolotta et al U.S. Pat. No. 3,933,672.

Other useful polymeric materials are the polyethylene glycols, particularly those of molecular weight 1000–10000, more particularly 2000 to 8000 and most preferably about 4000. These are used at levels of from 0.20% to 5% more preferably from 0.25% to 2.5% by weight. These polymers and the previously mentioned homo- or co-polymeric polycarboxylate salts are valuable for improving whiteness maintenance, fabric ash deposition, and cleaning performance on clay, proteinaceous and oxidizable soils in the presence of transition metal impurities.

Soil release agents useful in compositions of the present invention are conventionally copolymers or terpolymers of terephthalic acid with ethylene glycol and/or propylene glycol units in various arrangements. Examples of such polymers are disclosed in the commonly assigned U.S. Pat. Nos. 4,116,885 and 4,711,730 and European Published Patent Application No. 0 272 033. A particular preferred polymer in accordance with EP-A-0 272 033 has the formula $$(CH_3(PEG)_{43})_{0.75}(POH)_{0.25}[T\text{-}PO)_{2.8}(T\text{-}PEG)_{0.4}]T(PO\text{-}H)_{0.25}((PEG)_{43}CH_3)_{0.75}\text{-}$$

where PEG is $—(OC_2H_4)O—$, PO is $(OC_3H_6O)$ and T is $(pcOC_6H_4CO)$.

Also very useful are modified polyesters as random copolymers of dimethyl terephtalate, dimethyl sulfoisophtalate, ethylene glycol and 1–2 propane diol, the end groups consisting primarily of sulphobenzoate and secondarily of mono esters of ethylene glycol and/or propane-diol. The target is to obtain a polymer capped at both ends by sulphobenzoate groups, "primarily", in the present context most of said copolymers herein will be endcapped by sulphobenzoate groups. However, some copolymers will be less than fully capped and therefore their end groups may consist of monoester of ethylene glycol and/or propane 1–2 diol, thereof consist "secondarily" of such species.

The selected polyesters herein contain about 46% by weight of dimethyl terephtalic acid, about 16% by weight of propane -1.2 diol, about 10% by weight ethylene glycol, about 13% by weight of dimethyl sulfobenzoic acid and about 15% by weight of sulfoisophtalic acid, and have a molecular weight of about 3.000. The polyesters and their method of preparation are described in EPA 311 342.

Certain polymeric materials such as polyvinyl pyrrolidones typically of MW 5000–20000, preferably 10000–15000, also form useful agents in preventing the transfer of labile dyestuffs between fabrics during the washing process.

A suitable chelant for inclusion in the detergent compositions in accordance with the invention is ethylenediamine-N,N'-disuccinic acid (EDDS) or the alkali metal, alkaline earth metal, ammonium, or substituted ammonium salts thereof, or mixtures thereof. Preferred EDDS compounds are the free acid form and the sodium or magnesium salt thereof. Examples of such preferred sodium salts of EDDS include $Na_2EDDS$ and $Na_4EDDS$. Examples of such preferred magnesium salts of EDDS include MgEDDS and $Mg_2EDDS$. The magnesium salts are the most preferred for inclusion in compositions in accordance with the invention.

Fabric softening agents can also be incorporated into detergent compositions in accordance with the present invention. These agents may be inorganic or organic in type. Inorganic softening agents are exemplified by the smectite clays disclosed in GB-A-1,400,898. Preferably these clays have a cation exchange capacity of at least 50meq/100 gr. Different examples of clays are described in U.S. Pat. No. 1,400,898. Montmorillonite clays are widely used for this purpose. Certain hectoritc clays also provide good softness performance as described in U.S. Pat. No. 5,019,292. Organic fabric softening agents include the water-insoluble tertiary amines as disclosed in GB-A-1514276 and EP-B-0 011 340 and their combination with mono C12–C14 quaternary ammonium salts are disclosed in EP-B-0 026 527 and EP-B-0 026 528 and di-long-chain amides as disclosed in EP-B-0 242 919.

The softening system may contain a flocculating agent to improve clay deposition. Useful organic ingredients of said fabric softening systems include high molecular weight polyethylene oxide materials having a molecular weight of about 300.000 as disclosed in EP-A-0 299 575 and 0 3 13 146.

Levels of smectite clay are normally in the range from 5% to 20%, more preferably from 8% to 15% by weight with the material being added as a dry mixed component to the remainder of the formulation. Organic fabric softening agents such as the water-insoluble tertiary amines or di-long-chain amide materials are incorporated at levels of from 0.5% to 5% by weight, normally from 1% to 3% by weight whilst the high molecular weight polyethylene oxide materials and the water-soluble cationic materials are added at levels of from 0.1% to 2%, normally from 0.15% to 1.5% by weight. These materials are normally added to the spray dried portion of the composition, although in some instances it may be more convenient to add them as a dry mixed particulate, or spray them as a molten liquid on to other solid components of the composition.

Enzymes other than the specific peroxidase preparation herein can be present in the composition herein, such as proteases, lipuses, amylases and cellulases.

The detergent compositions according to the invention can be in liquid, paste or granular forms. The enzyme may be formulated in any convenient form, e.g. as a powder or liquid. The enzyme may be stabilized in a liquid by inclusion of enzyme stabilizers. Liquid detergents may further include stabilized hydrogen peroxide precursors.

Granular compositions according to the present invention can also be in "compact form", i.e. they may have a relatively higher density than conventional granular detergents, i.e. from 550 to 950 g/l, preferably from 650 to 950g/l; in such case, the granular detergent compositions according to the present invention will contain a lower amount of "inorganic filler salt", compared to conventional granular detergents; typical filler salts are alkaline earth metal salts of sulphates and chlorides, typically sodium sulphate; "compact" detergents typically comprise not more than 10% filler salt.

The present invention also relates to a process for inhibiting dye transfer from one fabric to another of solubilized and suspended dyes encountered during fabric laundering operations involving colored fabrics.

The process comprises contacting fabrics with a laundering solution as hereinbefore described.

The process of the invention is conveniently carried out in the course of the washing process. The washing process is preferably carried out at 5° C. to 75° C., especially 20° C, to 60° C. The pH of the treatment solution is preferably from 7 to 12, especially from 7 to 10.5.

The process and compositions of the invention can also be used as additive during laundry operations.

The following non-limiting examples illustrate the DTI systems and compositions of the present invention. All percentages, pans and ratios used herein are by weight unless otherwise specified.

EXAMPLES

Detergent compositions of the present invention are as follows:

| Component | Weight % | | |
|---|---|---|---|
| | Example 1 | Example 2 | Example 3 |
| C12 Linear Alkylbenzene Sulfonate | 10.5 | 10.3 | 8.6 |
| Tallow Alkyl Sulate | — | — | 2.6 |
| C14–15Alkyl Sulfonate | 6.7 | 6.6 | — |
| C14–15AE0.3S | 1.9 | 1.9 | — |
| C12–15AE3S | — | — | 0.2 |
| Neodol C12–13 alcohol ethoxylate (9) | 0.5 | 0.5 | — |
| Neodol C14–15 alcohol ethoxylate (7) | — | — | 5.0 |
| Tallow Alcohol Ethoxylate (11) | — | — | 1.3 |
| Zeolite | 25.4 | 26.3 | 27.2 |
| Na2CO3 | — | 26.0 | 10.7 |
| NaHCO3 | — | — | 7.0 |
| NaCitrate | — | — | 10.0 |
| Citric Acid | 2.5 | — | — |
| Na Silicate | 0.6 | 0.6 | 2.0 |
| Na2SO4 | 23.3 | | 5.0 |
| Protease | 0.8 | 0.3 | 1.6 |
| Lipase | — | 0.3 | 0.3 |
| CMC | — | — | 0.4 |
| Polyacrylate | 3.1 | 3.2 | — |
| Acrylate-maleate copolymer | — | — | 4.6 |
| PEG 4000 | 1.5 | 1.7 | — |
| Perborate monohydrate | 1.0 | 1.0 | 0.5 |
| Peroxidase[1] | 0.5 | 0.5 | 0.3 |
| 10-phenothiazine propionic acid (PPT) | 0.1 | 0.1 | 0.1 |
| H2O, Miscellaneous | | Balance | |

1 - Coprinus

The above detergent compositions of the present invention provide good dye transfer inhibition of fugitive dyes in wash solutions particularly when compared similar compositions containing no accelerator, i.e., PPT.

What is claimed is:

1. A dye transfer inhibition system comprising an effective amount of:

a) an enzyme exhibiting peroxidase activity;

b) a hydrogen peroxide source selected from the group consisting of a hydrogen peroxide, hydrogen peroxide precursor, and an enzymatic system capable of generating hydrogen peroxide; and c) an accelerator comprising an organic chemical compound selected from the group consisting of phenothiazine or phenoxazine having the formula:

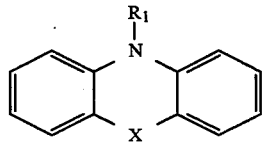

wherein X is S or O, $R_1$ is $—CH_3$, $—CH_2CH_3$, $CH_2CH_2CH_2NH_2$ or $—CH_2CH_2COOH$.

2. A detergent composition comprising a dye transfer inhibiting amount of the dye transfer inhibition system of claim 1.

* * * * *